US006142391A

United States Patent [19]

Seyed-Yagoobi et al.

[11] Patent Number: 6,142,391

[45] Date of Patent: Nov. 7, 2000

[54] SLOT JET REATTACHMENT NOZZLE AND METHOD OF OPERATION

[75] Inventors: Jamal Seyed-Yagoobi; Robert H. Page, both of College Station, Tex.

[73] Assignee: The Texas A&M University System, College Station, Tex.

[21] Appl. No.: 09/183,036

[22] Filed: Oct. 30, 1998

Related U.S. Application Data

[60] Provisional application No. 60/065,406, Oct. 31, 1997.

[51] Int. Cl.[7] ..... B05B 1/26

[52] U.S. Cl. ..... 239/524; 239/518

[58] Field of Search ..... 239/505, 507, 239/512, 513, 514, 518, 524

[56] References Cited

U.S. PATENT DOCUMENTS

| | | | |
|---|---|---|---|
| 3,635,407 | 1/1972 | Wheelock | 239/514 |
| 4,274,210 | 6/1981 | Stengard | 34/156 |
| 5,331,749 | 7/1994 | Thiele | 34/117 |
| 5,553,394 | 9/1996 | Cosley | 239/524 X |

FOREIGN PATENT DOCUMENTS

| | | | |
|---|---|---|---|
| 493277 | 8/1970 | Switzerland | B05B 7/00 |

OTHER PUBLICATIONS

J. Seyed–Yagoobi, "Enhancement of Heat and Mass Transfer with Innovative Impinging Jets," XP 000588856, Copyright © 1996 by Marcel Dekker, Inc., pp. 1173–1196.

Declaration of J. Seyed–Yagoobi and attached Drying Research Center brochure, Feb. 1, 1999.

Narayanan, V., et al., "*Comparison of Heat Transfer Characteristics of a Slot Jet Reattachment Nozzle and a Conventional Slot Jet Nozzle*", HTD–vol. 333, Proceeding of the ASME Heat Transfer Division, vol. 2, pp. 151–157, Nov. 17–22, 1996.

Narayanan, V., et al., "*Effect of Exit Angle on the Heat Transfer Characteristics of a Slot Jet Reattachment Nozzle and its Comparison to a Slot Jet Nozzle*", HTD–vol. 347, National Heat Transfer Conference, vol. 9, pp. 119–127, Aug. 8–12, 1997.

Alam, Syed Aftab, "*Comparison of SJR and Slot Jet Nozzles–Mass Transfer*", slides orally presented and distributed at the Drying Research Center meeting, Drying Research Center, Department of Mechanical Engineering, Texas A & M University, Apr. 1997.

Narayanan, Vinod, "*Comparison of SJR and Slot Jet Nozzles–Heat Transfer*", slides orally presented and distributed at the Drying Research Center meeting, Drying Research Center, Department of Mechanical Engineering, Texas A & M University, Apr. 1997.

Seyed–Yagoobi, J., "*Comparison of a Slot Jet Reattachment Nozzle to a Slot Jet Nozzle*", slides orally presented and distributed at the Drying Research Center meeting, Drying Research Center, Department of Mechanical Engineering, Texas A & M University, Apr. 1996.

*Primary Examiner*—Lesley D. Morris
*Attorney, Agent, or Firm*—Baker Botts L.L.P.

[57] ABSTRACT

The invention comprises a slot (20) operable to direct a substance through the slot (20), the slot (20) having a maximum inner width (23) and a maximum inner length (22), the ratio of the maximum inner length (22) to the maximum inner width (23) being greater than two. The invention further comprises a base (30) coupled to the slot (20), the base (30) having a width (28) greater than the maximum inner width (23) and a length (29) greater than the maximum inner length (22) to redirect the substance through the slot (20) at an angle.

According to another embodiment of the invention, a system for transferring a mass over an impingement surface (25) comprises a plurality of slot jet reattachment nozzles (10) operable to direct the substance over the impingement surface (25), the plurality of slot jet reattachment nozzles (10) located proximate to the impingement surface (25).

31 Claims, 3 Drawing Sheets

SLOT JET REATTACHMENT NOZZLE AND METHOD OF OPERATION

RELATED PATENT APPLICATION

This application claims the benefit of U.S. Provisional Application Serial No. 60/065,406 entitled *Slot Jet Reattachment Nozzle and Method of Operation*, filed Oct. 31,1997.

TECHNICAL FIELD OF THE INVENTION

This invention relates, in general, to the field of industrial systems and methods and, more particularly, to a slot jet reattachment nozzle and method of operation.

BACKGROUND OF THE INVENTION

Impinging jets are used extensively in various applications such as heating, cooling, or drying of paper, pulp, printers ink, food, tissue, textiles, chemicals, film, and in the cooling of electronic equipment, turbine, and combustor components. The attraction of these jet systems lies in their ability to control local transport rates by varying various parameters such as the jet diameter, jet-to-impingement surface spacing, and jet-to-jet spacing in addition to the flow rate and temperature. Systems that incorporate impinging jets generally consist of in-line, orifice or slot jets. A reservoir upstream of the nozzle provides the necessary flow pressure, and the flow exits the nozzle and impinges directly on an impingement surface.

However, these slot jets do not permit a means to control the force exerted on the impingement surface. For example, a standard air jet apparatus that transfers air directly perpendicular to the impingement surface such as wet paper web in a paper-drying application may exert too much force on the paper, resulting in breakage. These slot jets also do not provide uniform local heat transfer to the impingement surface, resulting in uneven drying patterns.

SUMMARY OF THE INVENTION

Therefore, the need has arisen for a slot jet reattachment nozzle and method of operation that overcomes the disadvantages and deficiencies of the prior art.

The invention comprises a slot operable to direct a substance through the slot. The slot has a maximum inner width and a maximum inner length. The ratio of the maximum inner length to the maximum inner width is greater than two. The invention further comprises a base coupled to the slot. The base has a width greater than the maximum inner width and a length greater than the maximum inner length to redirect the substance through the slot at an angle.

According to another embodiment of the invention, a system for transferring a substance over an impingement surface comprises a plurality of slot jet reattachment nozzles operable to direct the substance over the impingement surface. The plurality of slot jet reattachment nozzles are located proximate to the impingement surface.

According to another embodiment of the invention, a method for transferring a substance over an impingement surface comprises directing the substance through a slot. The slot has a maximum inner width and a maximum inner length. The ratio of the maximum inner length to the maximum inner width is greater than two. The method further comprises directing the substance through the slot and around a base coupled to the slot.

Embodiments of the invention provide various technical advantages. For example, a method for transferring a substance over an impingement surface that permits control of the surface pressure exerted on the impingement surface is provided. In addition, a method for transferring mass over an impingement surface that provides uniform local heat and/or mass transfer is provided. Another technical advantage is that embodiments of the invention may be used in applications requiring more compact equipment. Yet, another technical advantage is that embodiments of the invention may be used in a number of applications in a number of industries, for example, drying, heating, cooling and moisturizing of various materials. Other technical advantages are readily apparent to one skilled in the art from the following figures, description, and claims.

BRIEF DESCRIPTION OF THE DRAWINGS

A more complete understanding of the present invention may be acquired by referring to the accompanying Figures where like reference numbers are used to refer to like features and wherein.

DETAILED DESCRIPTION OF THE INVENTION

Embodiments of the present invention and its advantages are best understood by referring to FIGS. 1–8 of the drawings, like numerals being used for like and corresponding parts of the various drawings.

Figure 1:
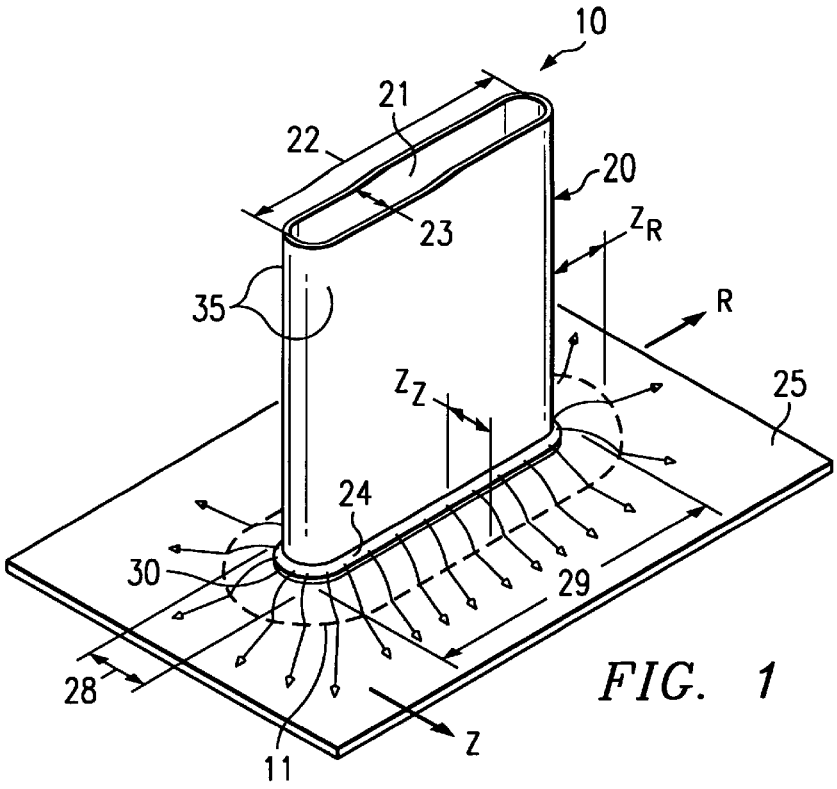
FIG. 1 is a schematic diagram illustrating a slot jet reattachment nozzle and a typical flow pattern for the nozzle.

FIG. 1 is a schematic diagram illustrating a flow pattern for a slot jet reattachment nozzle 10. Slot jet reattachment nozzle 10 includes a slot 20 and a base 30. Slot 20 has a maximum inner width 23 and maximum inner length 22. The ratio of maximum inner length 22 to maximum inner width 23 is at least 2.0. Slot 20 has an outer edge 35. Slot 20 is aligned with inner length 22 parallel to a radial direction R and inner width 23 parallel to a lengthwise direction Z. In this embodiment, slot 20 is generally rectangular, with semicircular ends. In this embodiment, maximum inner length 22 is measured, internal to slot 20, from the edge of one semicircular end to the opposite semicircular end through the center of slot 20. In this embodiment, maximum inner width 23 is measured, internal to slot 20, from one lengthwise edge to the opposite lengthwise edge through the center of slot 20. Base 30 has a width 28 wider than maximum inner width 23 and a length 29, longer than maximum inner length 22 of slot 20, in order to direct flow of the mass according to a desired reattachment on impingement surface 25.

A mass or substance, usually air, is directed through slot 20 with a hydraulic diameter 21 defined generally by the formula:

$$\text{Hydraulic Diameter}=4\times\text{flow cross-sectional area/wetted perimeter},$$

where the wetted perimeter is the perimeter of the internal walls of slot 20 with which the flow through the cross-sectional area interacts. The mass is directed outward through exit opening 24 by base 30 and the mass reattaches on an impingement surface 25 located near base 30. The turbulent mixing that occurs at the boundaries of this mass flow induces secondary mass flow by entrainment. This secondary mass flow causes the mass to reattach to impingement surface 25 in the form of a reattachment band 11. In this embodiment, reattachment band 11 is located a radial distance $Z_R$ from the semicircular edge of slot 20 and a lengthwise distance $Z_Z$ from the lengthwise edge of slot 20. $Z_R$ and $Z_Z$ are reattachment distances. Slot jet reattachment nozzle 10 as illustrated in FIG. 1 provides uniform heat and/or mass transfer to, as well as excellent control of force exerted on, impingement surface 25. An embodiment using a ratio of maximum inner length 22 to maximum inner width 23 in the range between 7 and 8 is particularly advantageous in this regard. This design is desirable because it provides uniform heat and/or mass transfer around slot jet reattachment nozzle 10, at reattachment band 11. A more detailed description of geometrical parameters associated with slot jet reattachment nozzle 10 is provided in conjunction with FIGS. 2 through 4.

Figure 2:
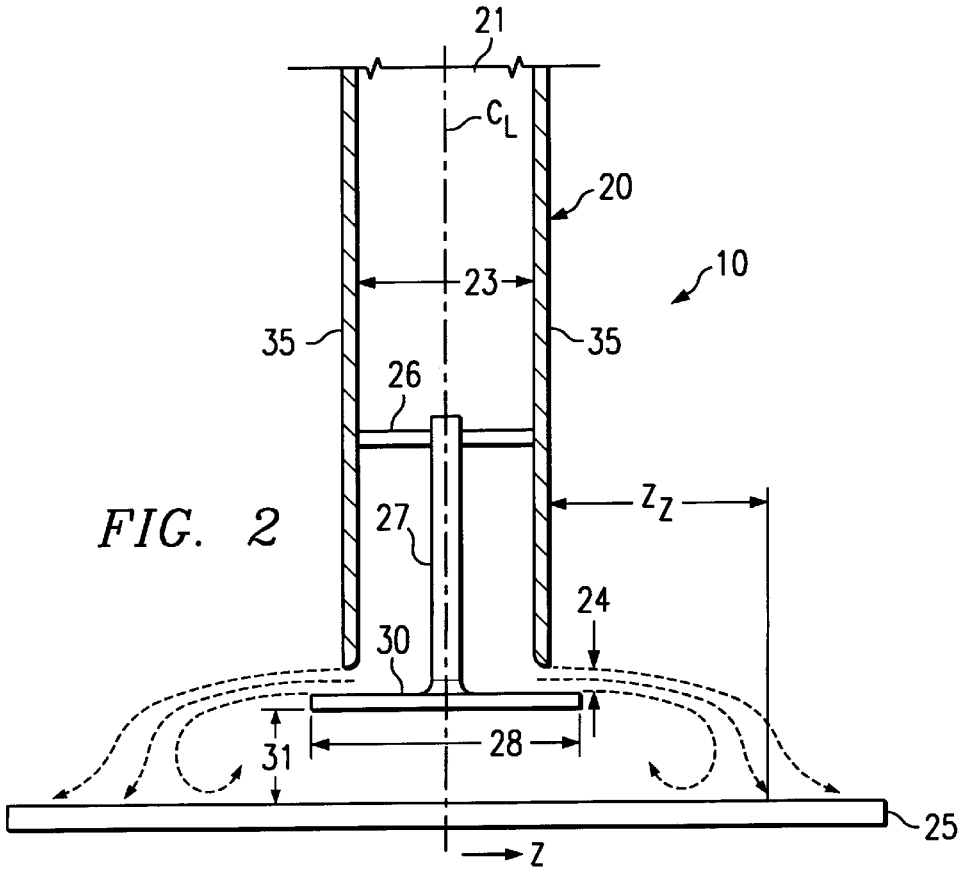
FIG. 2 is a schematic diagram illustrating the geometrical parameters of the slot jet reattachment nozzle of FIG. 1 at a zero degree exit angle.

FIG. 2 is a schematic diagram illustrating geometrical parameters of slot jet reattachment nozzle 10. Slot jet reattachment nozzle 10 is centered about a central longitudinal axis $C_L$ and is positioned near impingement surface 25. Mass is directed through slot 20 and exits through exit opening 24, where turbulence induces secondary mass flow by entrainment and causes the mass to reattach to impingement surface 25 at reattachment band 11 as shown in FIG. 1. The fluid at reattachment band 11 splits such that part of it recirculates under base 30 while the rest flows outwardly, as shown in FIG. 2.

In this embodiment, base 30 is coupled to slot 20 to direct mass flow as it exits slot 20 through exit opening 24 in a direction generally parallel to impingement surface 25 at a flow exit angle of zero degrees relative to the bottom of base 30. Slot 20 and base 30 are coupled in this embodiment, for example, by pin 26 and pin 27 centered around central longitudinal axis $C_L$, to avoid disturbing flow of the mass as it exits slot 20 through exit opening 24 and so that the mass reattaches on impingement surface 25 at radial distance $Z_R$ and at lengthwise distance $Z_Z$. Although pin 26 and pin 27 are not movable in this embodiment, other suitable embodiments may provide movable coupling of base 30 to slot 20, should it be desirable to alter the size of exit opening 24. In addition, collars coupled to outer edge 35 of slot 20 may be used to regulate mass flow through exit opening 24.

It has been determined that placing base 30 at a height 31 from impingement surface 25 that is between one-half and three-fourths of hydraulic diameter 21 is particularly advantageous for producing high heat transfer to impingement surface 25. Positioning base 30 at height 31 in this range of values from impingement surface 25 provides greater heat and/or mass transfer to impingement surface 25 in both lengthwise direction Z and radial direction R than can be provided by other values for height 31.

Enhancements in reducing the force exerted on impingement surface 25 may be obtained by designing slot jet reattachment nozzle 10 with a positive or negative exit angle. Zero or even negative net forces that may be useful in a number of applications involving fragile impingement surfaces 25 such as wet paper web may be obtained in the recirculation region below base 30 by simply varying the angle of exit opening 24 from zero degrees. Further, as the angle of exit opening 24 is increased, the spread of reattachment band 11 on impingement surface 25 decreases. Geometrical parameters for non-zero exit angles are shown in FIGS. 3 and 4.

Figure 3:
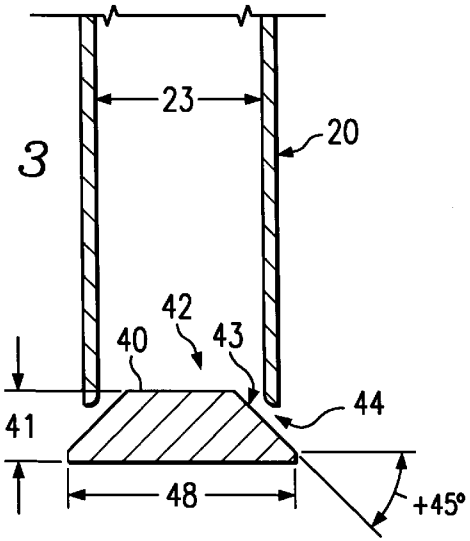
FIG. 3 is a schematic diagram illustrating geometrical parameters of the slot jet reattachment nozzle of FIG. 1 at a forty-five degree exit angle.

FIG. 3 is a schematic diagram illustrating slot jet reattachment nozzle 10 with a forty-five degree exit angle relative to the bottom of base 30. Designing slot jet reattachment nozzle 10 with a positive exit angle of, for example, ten degrees reduces the size of reattachment band 11 on impingement surface 25 and increases the local heat and/or mass transfer to impingement surface 25. Utilizing a positive angle may thus be useful in applications requiring smaller reattachment bands 11, such as moving belt operations where limited space is available, for example, as with cooking food in small ovens.

In this embodiment, base 40 is structured differently from base 30 as shown in FIG. 2. Base 40 has a width 48 that is wider than inner width 23, but that is the same dimension as width 28 as shown in FIG. 2. However, base 40 has base height 41 and inner base width 42 to support tapering of edge 43. Edge 43 permits the exit of mass flow through exit opening 44 at a forty-five degree exit angle from slot 20. Base 40 and slot 20 are coupled in this embodiment by similar suitable means, such as pin 26 and pin 27, as were discussed in conjunction with FIG. 2, to avoid disturbing flow of the mass as it exits slot 20, and so that it reattaches properly on impingement surface 25 as desired.

Figure 4:
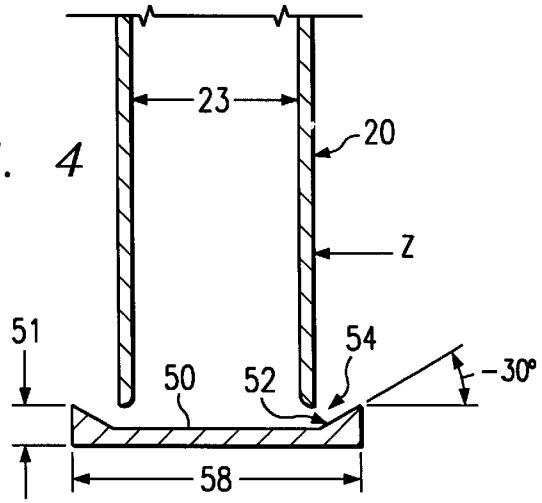
FIG. 4 is a schematic diagram illustrating geometrical parameters of the slot jet reattachment nozzle of FIG. 1 at a negative ten degree exit angle.

FIG. 4 is a schematic diagram illustrating geometric parameters of slot jet reattachment nozzle 10 at a negative thirty degree wall exit angle provided in part by inner curvature 52. Inner curvature 52 orients the flow of mass to a negative ten degree flow exit angle relative to the bottom of base 30 from slot jet reattachment nozzle 10. Designing a slot jet reattachment nozzle 10 with a negative exit wall angle of, for example, thirty degrees enlarges the size of reattachment band 11 on impingement surface 25 and provides a negative surface force on impingement surface 25. Utilizing a negative angle may thus be useful in applications where exerting positive surface forces are undesirable, such as drying fragile fabrics or wet paper. Utilizing a negative wall exit angle may also be useful in applications where exerting negative surface forces are desirable, such as lifting semiconductor chips.

In this embodiment, base 50 has a width 58 that is wider than inner width 23 of slot 20, but that is the same dimension as width 28, as shown in FIG. 2. Base 50 also has an inner curvature 52 supported by an outer height 51, which directs mass flow through exit opening 54 at an angle of negative ten degrees relative to the bottom of base 30. Inner curvature 52 is structured to allow compensation for turbulence in the exit of mass flow through exit opening 54, so that the exit of mass flow through exit opening 54 is oriented to a negative ten degree flow exit angle relative to the bottom of base 30.

Radial distance $Z_R$ and lengthwise distance $Z_Z$ as depicted in FIG. 1 vary with inner width 23 and inner length 22 as a function of the geometry of slot jet reattachment nozzle 10, mass flow, and height 31 as depicted in FIG. 2. Generally, both radial distance $Z_R$ and lengthwise distance $Z_Z$ increase as the exit angle of slot jet reattachment nozzle 10 decreases, as illustrated in FIG. 4 by one embodiment of the invention. Thus, reattachment band 11 enlarges as the exit angle of slot jet reattachment nozzle 10 decreases below zero degrees.

Both radial distance $Z_R$ and lengthwise distance $Z_Z$ also increase as height 31 is increased. Thus, reattachment band 11 enlarges as slot jet reattachment nozzle 10 is positioned further away from impingement surface 25. However, reattachment of the mass on impingement surface 25 may not occur where height 31 reaches a height maximum exceeding a value of five, where height maximum is defined by the relationship:

$$\text{Height Maximum} = \frac{\text{height 31}}{\text{width 28 of base 30}}$$

Both radial distance $Z_R$ and lengthwise distance $Z_Z$ vary little as a function of the size of exit opening 24. Radial distance $Z_R$ and lengthwise distance $Z_Z$ are subject to minor variations caused by changes in mass flow turbulence as hydraulic diameter 21 of slot 20 decreases. Similarly, reattachment of the mass on impingement surface 25 may not occur where slot jet reattachment nozzle 10 utilizes a wall angle, provided in part by inner curvature 52, that exceeds negative thirty degrees.

Most industrial applications require drying, heating, cooling or moisturizing a variety of impingement surfaces 25 in large quantities or areas. These impingement surfaces include, but are not limited to, films, prints, paper and pulp, food, textiles, electronics, tempering materials, and various surfaces used in pharmaceutical and multifunctional manufacturing applications such as lifting, transporting, and cooling of semiconductor chips.

According to the teachings of the present invention, it is recognized that it will be useful in many industrial applications to utilize a plurality of slot jet reattachment nozzles 10. Configurations using a plurality of slot jet reattachment nozzles 10 are described in conjunction with FIGS. 5–8, and provide embodiments that utilize an optimal spacing between each slot jet reattachment nozzle 10. This optimal spacing is expressed as a function of the location of reattachment band 11, as illustrated in FIG. 1, around each slot jet reattachment nozzle 10. This optimal spacing provides the best control of force exerted on impingement surface 25, or surface pressure, while retaining the most uniform reattachment band 11 around each slot jet reattachment nozzle 10, and is discussed in further detail in conjunction with FIGS. 5–8.

There are innumerable applications for utilizing a plurality of nozzle systems and, according to the teachings of the invention, each application mandates certain requirements for the size of reattachment band 11 and for proper surface pressure. For example, the optimal spacing for one application in the food industry may differ from another optimal spacing in the paper and pulp drying industry. However, these applications all benefit from optimal spacing for configurations using a plurality of slot jet reattachment nozzles that fall within a quantifiable range, as described in FIGS. 5–8.

Figure 5:
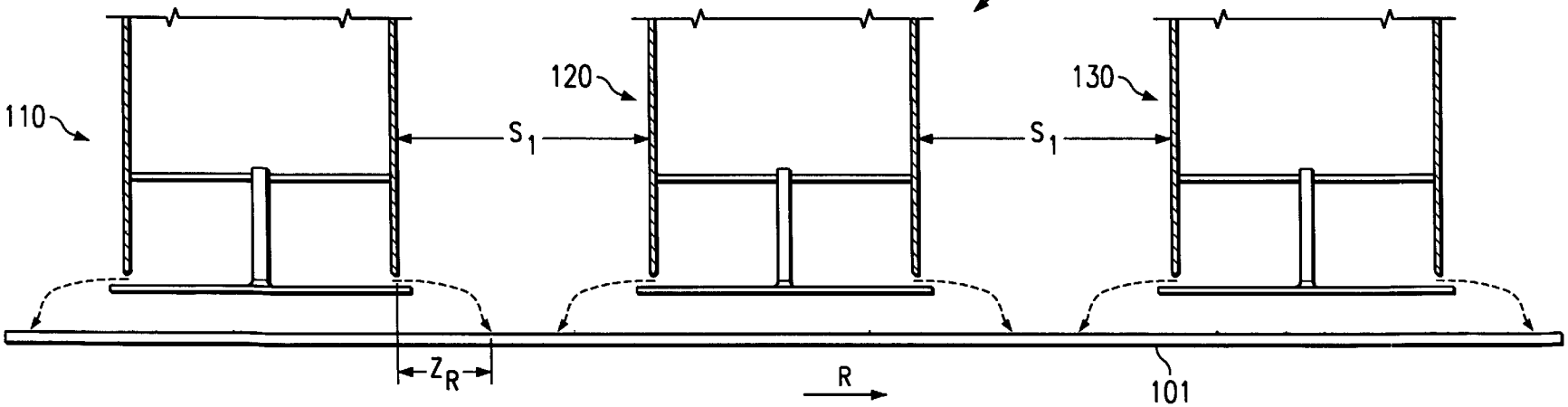
FIG. 5 is a schematic diagram illustrating a one-dimensional array of three slot jet reattachment nozzles.

FIG. 5 illustrates a one-dimensional array flow transfer system 100 and impingement surface 101. Flow transfer system 100 includes a one-dimensional array of slot jet reattachment nozzles 110, 120, and 130. A one-dimensional array is generally defined as two or more adjacent slot jet reattachment nozzles 10 that are generally aligned in radial direction R, each spaced apart by a distance S1. In this embodiment, slot jet reattachment nozzles 110, 120, and 130 are identical to slot jet reattachment nozzle 10, which is described above in conjunction with FIGS. 1 and 2. Flow transfer system 100 utilizes a one-dimensional array of slot jet reattachment nozzles 110, 120, and 130 to provide the most uniform reattachment and control of pressure exerted on impingement surface 101.

Because of interaction between flows of mass exiting from adjacent slot jet reattachment nozzles 110, 120, and 130, the reattachment and surface pressure properties on impingement surface 101 for flow transfer system 100 differ from those of a single slot jet reattachment nozzle 10. Optimal radial spacing S1 between any adjacent slot jet reattachment nozzles 110 and 120, and 120 and 130 occurs at a between-nozzle spacing ratio of between three and six times radial distance $Z_R$. This spacing provides the most optimal zone of interaction between slot jet reattachment nozzles 110, 120, and 130. Positioning adjacent slot jet reattachment nozzle 10 outside this range for optimal radial spacing S1 results in sub-optimal values for reattachment and surface pressure control.

Values less than three for optimal radial spacing S1 result in reattachment interactions between slot jet reattachment nozzles 110, 120, and 130. On the other hand, values greater than six for optimal radial spacing S1 result in wasted process space between slot jet reattachment nozzles 110, 120, and 130.

Figure 6:
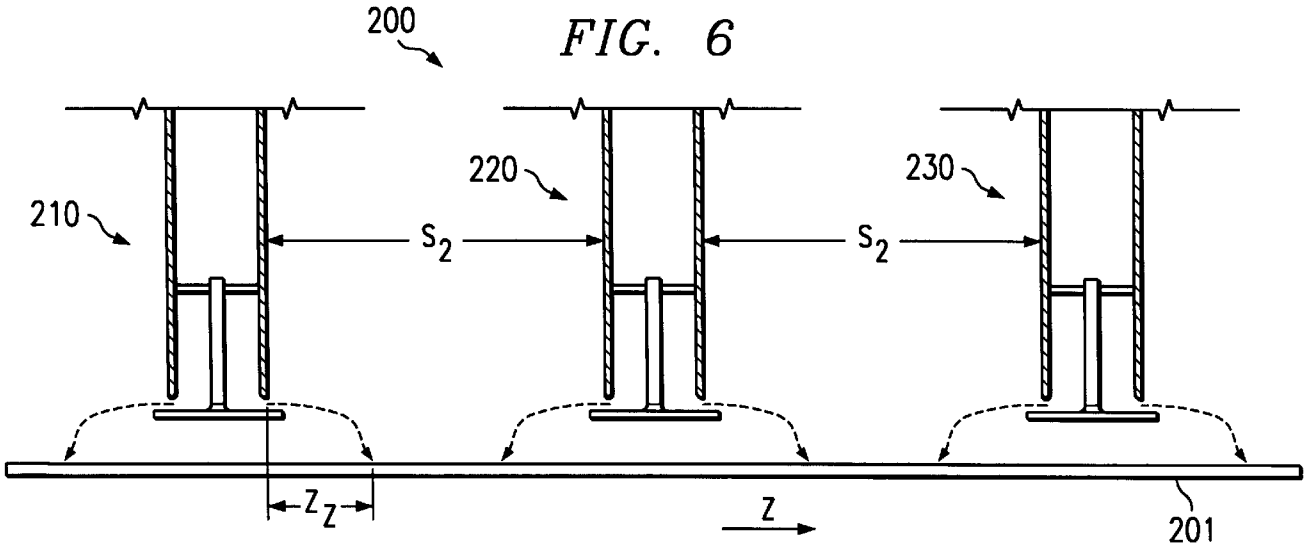
FIG. 6 is a schematic diagram illustrating a one-dimensional matrix of three slot jet reattachment nozzles.

FIG. 6 illustrates a one-dimensional matrix transfer system 200 and impingement surface 201. Flow transfer system 200 includes a one-dimensional matrix of nozzles 210, 220, and 230. A one-dimensional matrix of nozzles is generally defined as two or more adjacent slot jet reattachment nozzles 10 that are generally aligned in lengthwise direction Z, each spaced apart by a distance S2. In this embodiment, slot jet reattachment nozzles 210, 220, and 230 are identical to slot jet reattachment nozzle 10, which is described above in conjunction with FIGS. 1 and 2. Flow transfer system 200 utilizes a one-dimensional matrix of nozzles to provide the most uniform reattachment and control of force exerted on impingement surface 201.

Because of interaction between flow of mass exiting from adjacent nozzles, the reattachment and surface pressure properties on impingement surface 201 for flow transfer system 200 differ from those of a single nozzle. Optimal lengthwise spacing S2 between any adjacent slot jet reattachment nozzles 210 and 220, and 220 and 230, occurs at a between-nozzle spacing ratio of between three and six times lengthwise distance $Z_Z$. This spacing provides the most optimal zone of interaction between slot jet reattachment nozzles 210, 220, and 230. Positioning adjacent slot jet reattachment nozzles 10 outside this range results in sub-optimal values for reattachment and surface pressure control, as discussed in conjunction with FIG. 5.

Figure 7:
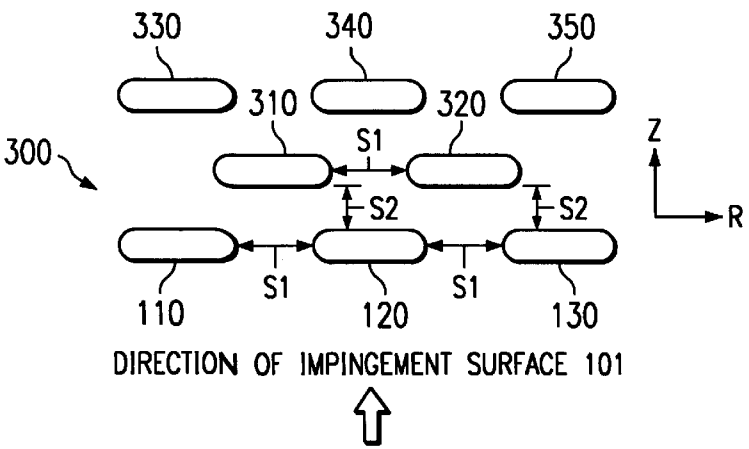
FIG. 7 is a top view of a two-dimensional staggered matrix of slot jet reattachment nozzles.

FIG. 7 is a top view of a two-dimensional staggered matrix transfer flow system 300 over impingement surface 101. In this embodiment, impingement surface 101 may move relative to two-dimensional staggered matrix transfer flow system 300. For example, impingement surface 101 may be placed on a conveyor belt which moves relative to two-dimensional staggered matrix transfer flow system 300, which remains stationary. A two-dimensional staggered matrix of nozzles is generally defined as two or more adjacent nozzles that are generally aligned in radial direction R, each spaced apart by optimal radial spacing S1, with a third nozzle offset from the first two nozzles. The third nozzle is offset from the first two nozzles at optimal lengthwise spacing S2 in lengthwise direction Z. The third nozzle is also offset at generally the midpoint of optimal radial spacing S1 between the first two nozzles. FIG. 7 illustrates the structure of this two-dimensional staggered matrix of slot jet reattachment nozzles 110, 120, 130, and 310 through 350. Slot jet reattachment nozzles 110, 120, and 130 are positioned in a one-dimensional array aligned in radial direction R, as discussed in conjunction with FIG. 5. Third and fourth slot jet reattachment nozzles 310 and 320 can also be envisioned as another one-dimensional array of nozzles aligned in radial direction R, as described in conjunction with FIG. 5. One-dimensional array of slot jet reattachment nozzles 110, 120, and 130 is substantially parallel to one-dimensional array of slot jet reattachments nozzles 310 and 320, and spaced apart at optimal lengthwise spacing S2 in lengthwise direction Z. Optimal lengthwise spacing S2 between nozzles 110 and 120 and nozzle 310 is in the range of about three to six times lengthwise direction $Z_Z$. The central longitudinal axis of nozzle 310 is staggered at generally the midpoint of distance S1 between slot jet reattachment nozzle 110 and slot jet reattachment nozzle 120. Similarly, the central longitudinal axis of nozzle 320 is staggered at generally the midpoint of distance S1 between slot jet reattachment nozzle 120 and slot jet reattachment nozzle 130.

More one-dimensional arrays of slot jet reattachment nozzles can be similarly added. For example, a third one-dimensional array of slot jet reattachment nozzles 330, 340, and 350 aligned in radial direction R are spaced apart at optimal lengthwise spacing S2 from one-dimensional array of slot jet reattachment nozzles 310 and 320. One-dimensional array of slot jet reattachment nozzles 330, 340, and 350 is aligned with one-dimensional array slot jet reattachment nozzles 110, 120, and 130. One-dimensional array of slot jet reattachment nozzles 330, 340, and 350 is also similarly staggered from one-dimensional array of slot jet reattachment nozzles 310 and 320 such that the central longitudinal axis of slot jet reattachment nozzle 310 is positioned at generally the midpoint of distance S between slot jet reattachment nozzles 330 and 340. In this way, a substantially large two-dimensional staggered matrix of slot jet reattachment nozzles 10 may be structured with additional one-dimensional arrays with any number of slot jet reattachment nozzles 10, in both directions.

Optimal radial spacing S1 and optimal lengthwise spacing S2 are given as ranges that provide the most optimal zones of interaction between all of the slot jet reattachment nozzles 10 in two-dimensional staggered matrix flow transfer system 300. Similarly, as described in conjunction with FIGS. 5 and 6, positioning adjacent slot jet reattachment nozzle 10 outside these ranges results in sub-optimal values for reattachment and surface pressure control. Although FIG. 7 illustrates a plurality of slot jet reattachment nozzles 10 spaced at regular and equal optimal radial spacings S1 generally in the radial direction and optimal lengthwise spacings S2 generally in the lengthwise direction, the plurality of slot jet reattachment nozzles 10 may be spaced apart unequally. For example, in the radial direction, the plurality of slot jet reattachment nozzles 10 may be spaced at various distances that are within the range for optimal radial spacing S1.

Figure 8:
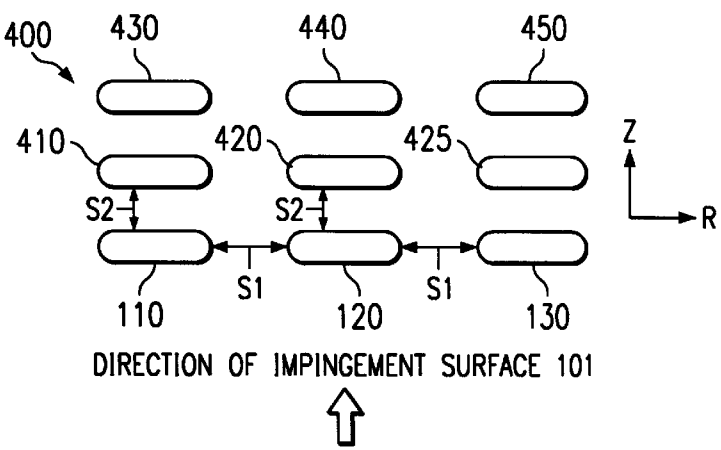
FIG. 8 is a top view of a two-dimensional aligned matrix of slot jet reattachment nozzles.

FIG. 8 is a top view of a two-dimensional aligned matrix transfer flow system 400 over impingement surface 101. In this embodiment, impingement surface 101 may move relative to two-dimensional aligned matrix transfer flow system 400. For example, impingement surface 101 may be placed on a conveyor belt which moves relative to two-dimensional aligned matrix transfer flow system 400, which remains stationary. A two-dimensional aligned matrix of nozzles is generally defined as two or more adjacent nozzles that are generally aligned in radial direction R, each spaced apart by a distance S1, with a third nozzle offset and generally aligned with the first nozzle in lengthwise direction Z, at optimal lengthwise spacing S2. FIG. 8 illustrates the structure of this two-dimensional aligned matrix of slot jet reattachment nozzles 110, 120, 130, and 410 through 450. Slot jet reattachment nozzles 110, 120, and 130 are positioned in a one-dimensional array aligned in radial direction R, as discussed in conjunction with FIG. 5. Third and fourth slot jet reattachment nozzles 410, 420, and 425 can also be envisioned as another one-dimensional array of slot jet reattachment nozzles as aligned in radial direction R, as described in conjunction with FIG. 5. One-dimensional array of slot jet reattachment nozzles 110, 120, and 130 is substantially parallel with one-dimensional array of slot jet reattachment nozzles 410, 420, and 425 and spaced apart at optimal lengthwise spacing S2 in lengthwise direction Z. Optimal lengthwise spacing S2 between slot jet reattachment nozzles 110 and 120 and slot jet reattachment nozzle 410 is in the range of about three to six times lengthwise direction $Z_Z$. The central longitudinal axis of slot jet reattachment nozzle 410 is aligned with that of slot jet reattachment nozzle 110. Similarly, the central longitudinal axis of slot jet reattachment nozzle 420 is aligned with that of nozzle 120.

More one-dimensional arrays of slot jet reattachment nozzle 110 can be similarly added. For example, a third one-dimensional array of slot jet reattachment nozzles 430, 440, and 450 aligned in radial direction R is spaced apart at optimal lengthwise spacing S2 from one-dimensional array of slot jet reattachment nozzles 410 and 420. One-dimensional array of slot jet reattachment nozzles 430, 440, and 450 are aligned with one-dimensional arrays of nozzles 110, 120, and 130 and slot jet reattachment nozzles 410, 420, and 425. In this way, a substantially large two-dimensional aligned matrix of slot jet reattachment nozzles 10 may be structured with additional one-dimensional arrays with any number of slot jet reattachment nozzles 10, in both directions.

Optimal radial spacing S1 and optimal lengthwise spacing S2 are given as ranges which provide the most optimal zones of interaction between all of the slot jet reattachment nozzles 10 in two-dimensional aligned matrix flow transfer system 400. Similarly, as described in conjunction with FIGS. 5 and 6, positioning adjacent slot jet reattachment nozzle 10 outside these ranges results in sub-optimal values for reattachment and surface pressure control. Although FIG. 8 illustrates a plurality of slot jet reattachment nozzles 10 spaced at regular and equal optimal radial spacings S1 generally in the radial direction and optimal lengthwise spacings S2 generally in the lengthwise direction, the plurality of slot jet reattachment nozzles 10 may be spaced apart unequally. For example, in the radial direction, the plurality of slot jet reattachment nozzles 10 may be spaced at various distances that are within the range for optimal radial spacing S1.

Although FIGS. 5 through 8 illustrate a plurality of slot jet reattachment nozzles 10 positioned perpendicular to impingement surfaces 101 and 201, slot jet reattachment nozzles 10 may be placed at various angles relative to impingement surfaces 101 and 201 for use in a variety of applications. For example, slot jet reattachment nozzles 10 may rotate through many angles generally not perpendicular to impingement surfaces 101 and 201 to provide varying heating or drying conditions. For the same reason, a plurality of slot jet reattachment nozzles 10 with varying nozzle geometry may be used for any one application.

It will be understood by those skilled in the art that a plurality of slot jet reattachment nozzles 10 may be positioned anywhere relative to an impingement surface 101, and may also be utilized in conjunction with a specialized impingement surface 101. For example, applications requiring heating or drying of food products may include a plurality of slot jet reattachment nozzles 10 positioned both above and below a stainless steel mesh conveyor belt. The pluralities of slot jet reattachment nozzles 10 both dry the food products, as well as heat the conveyor belt, to fully process the food products carried on the conveyor belt.

Although the invention has been particularly shown and described by the foregoing detailed description, it will be understood by those skilled in the art that various other changes in form and detail may be made without departing from the spirit and scope of the invention.

What is claimed is:

1. A slot jet reattachment nozzle, comprising:

a slot operable to direct a substance through the slot, the slot having a maximum inner width and a maximum inner length, the ratio of the maximum inner length to the maximum inner width being greater than two; and a base coupled to the slot, the base having a width greater than the maximum inner width and a length greater than the maximum inner length to redirect the substance through the slot at an angle.

2. The system of claim 1, wherein the slot is operable to direct a uniform flow of the substance through the slot.

3. The system of claim 1, wherein the slot is generally oval shaped.

4. The system of claim 1, wherein the slot is generally rectangular shaped with semi-circular ends.

5. The system of claim 1, wherein the slot is generally oval shaped having an irregularly shaped side.

6. The system of claim 1, wherein the ratio is between 7 and 8.

7. The system of claim 1, wherein the base is coupled to the slot such that it is operable to direct transfer of the substance through the slot at an exit angle substantially equal to zero.

8. The system of claim 1, wherein the base is coupled to the slot such that it is operable to direct transfer of the mass through the slot at an exit angle substantially not equal to zero.

9. A method for transferring a substance over an impingement surface comprising:

directing the substance through a slot, the slot having a maximum inner width and a maximum inner length, the ratio of the maximum inner length to the maximum inner width being greater than two; and directing the substance through the slot and around a base coupled to the slot.

10. The method of claim 9, wherein directing the substance through the slot and around a base further comprises directing the substrate such that a reattachment band is formed on the impingement surface.

11. The method of claim 9 further comprising directing the substance through the slot such that the substance reattaches in a relatively symmetric pattern on the impingement surface about a center axis of the slot.

12. The method of claim 9 further comprising directing the substance through the slot such that the substance exits the slot in a direction generally parallel to the impingement surface.

13. The method of claim 9 further comprising directing the substance through the slot such that the substance exits the slot in a direction generally nonparallel to the impingement surface.

14. A system for transferring a substance over an impingement surface, comprising:

a plurality of slot jet reattachment nozzles operable to direct the substance over the impingement surface, the plurality of slot jet reattachment nozzles located proximate to the impingement surface, each slot jet reattachment nozzle comprising:

a slot operable to direct at least a portion of the substance through the slot, the slot having an outer edge, the slot further having a maximum inner width along a lengthwise direction of the slot and a maximum inner length along a radial direction of the slot, the ratio of the maximum inner length to the maximum inner width being greater than two; and a base coupled to the slot, the base having a width greater than the maximum inner width and a length greater than the maximum inner length to redirect at least a portion of the substance through the slot at an angle.

15. The system of claim 14 wherein the plurality of slot jet reattachment nozzles further comprises:

a first slot jet reattachment nozzle, the first slot jet reattachment nozzle operable to direct at least a portion of the substance over the impingement surface such that at least a portion of the substance reattaches at a first radial distance from the first slot jet reattachment nozzle;

a second slot jet reattachment nozzle, the second slot jet reattachment nozzle operable to direct at least a portion of the substance over the impingement surface such that at least a portion of the substance reattaches at a second radial distance from the second slot jet reattachment nozzle; and wherein the first slot jet reattachment nozzle and second slot jet reattachment nozzle are aligned generally along the radial direction and spaced apart at a radial spacing distance measured between the outer edge of the first slot jet reattachment nozzle and the outer edge of the second slot jet reattachment nozzle in the range of about three to six times the first radial distance.

16. The system of claim 15 wherein the first radial distance is substantially equal to the second radial distance.

17. The system of claim 15 wherein the plurality of slot jet reattachment nozzles further comprises:

a third slot jet reattachment nozzle generally centered about a central longitudinal axis, the third slot jet reattachment nozzle operable to direct at least a portion of the substance over the impingement surface such that at least a portion of the substance reattaches at a lengthwise distance from the third slot jet reattachment nozzle;

wherein the first slot jet reattachment nozzle, second slot jet reattachment nozzle and third slot jet reattachment nozzle are spaced apart at a lengthwise spacing distance measured by the shortest distance between an axis connecting the outer edges of the first slot jet reattachment nozzle and the second slot jet reattachment nozzle, and the outer edge of the third slot jet reattachment nozzle in the range of about three to six times the lengthwise distance.

18. The system of claim 17 wherein the central longitudinal axis is positioned at generally the midpoint of the radial spacing distance between the first slot jet reattachment nozzle and the second slot jet reattachment nozzle.

19. The system of claim 17 wherein the first slot jet reattachment nozzle and the third slot jet reattachment nozzle are aligned generally along the lengthwise direction and spaced apart at a second lengthwise spacing distance measured between the outer edge of the first slot jet reattachment nozzle and the outer edge of the third slot jet reattachment nozzle in the range of about three to six times the lengthwise distance.

20. The system of claim 14 wherein the plurality of slot jet reattachment further nozzles comprises:

a first slot jet reattachment nozzle, the first slot jet reattachment nozzle operable to direct at least a portion of the substance over the impingement surface such that at least a portion of the substance reattaches at a first lengthwise distance from the first slot jet reattachment nozzle;

a second slot jet reattachment nozzle operable to direct at least a portion of the substance over the impingement surface such that at least a portion of the substance reattaches at a second lengthwise distance from the second slot jet reattachment nozzle; and wherein the first slot jet reattachment nozzle and second slot jet reattachment nozzle are aligned generally along the lengthwise direction and are spaced apart at a lengthwise spacing distance measured between the outer edge of the first slot jet reattachment nozzle and the outer edge of the second slot jet reattachment nozzle in the range of about three to six times the first lengthwise distance.

21. The system of claim 20 wherein the first lengthwise distance is substantially equal to the second lengthwise distance.

22. A method for transferring a substance over an impingement surface, comprising:

positioning a first slot jet reattachment nozzle having a first maximum inner width along the lengthwise direction and a first maximum inner length along the radial direction, a first slot outer edge, and first reattachment distance proximate to the impingement surface;

positioning a second slot jet reattachment nozzle having a second maximum inner width along the lengthwise direction and a second maximum inner length along the radial direction, a second slot outer edge, and a second reattachment distance proximate to the impingement surface, and adjacent to the first slot jet reattachment nozzle such that the distance between the first slot outer edge and the second slot outer edge is between three to six times the first reattachment distance; and directing the substance through the first slot jet reattachment nozzle and the second slot jet reattachment nozzle over the impingement surface.

23. The method of claim 22, further comprising aligning the second slot jet reattachment nozzle adjacent to the first slot jet reattachment nozzle generally in the radial direction.

24. The method of claim 22, further comprising aligning the second slot jet reattachment nozzle adjacent to the first slot jet reattachment nozzle generally in the lengthwise direction.

25. The method of claim 22 further comprising positioning the first slot jet reattachment nozzle and the second slot jet reattachment nozzle for heating an impingement surface.

26. The method of claim 22 further comprising positioning the first slot jet reattachment nozzle and the second slot jet reattachment nozzle for cooling an impingement surface.

27. The method of claim 22 further comprising positioning the first slot jet reattachment nozzle and the second slot jet reattachment nozzle for drying an impingement surface.

28. The method of claim 22 further comprising positioning the first slot jet reattachment nozzle and the second slot jet reattachment nozzle for moisturizing an impingement surface.

29. The method of claim 22 further comprising directing the substance through the first slot jet reattachment nozzle and the second slot jet reattachment nozzle over food products.

30. The method of claim 22 further comprising directing the substance through the first slot jet reattachment nozzle and the second slot jet reattachment nozzle over products used to manufacture paper.

31. The method of claim 22 further comprising directing the substance through the first slot jet reattachment nozzle and the second slot jet reattachment nozzle over items processed in multifunctional manufacturing.

* * * * *